United States Patent [19]

Lybecker et al.

[11] 4,416,085

[45] Nov. 22, 1983

[54] AUTOMATIC GATE OPENER

[75] Inventors: Robert W. Lybecker; Karl A. Senghaas, both of San Antonio; James W. Olafson, Kerrville, all of Tex.

[73] Assignee: Bomar Corporation, San Antonio, Tex.

[21] Appl. No.: 373,859

[22] Filed: May 3, 1982

[51] Int. Cl.[3] ..... E05F 15/02

[52] U.S. Cl. ..... 49/340

[58] Field of Search ..... 49/340, 344, 345, 280, 49/282, 324, 326, 327, 330, 70, 507

[56] References Cited

U.S. PATENT DOCUMENTS

| | | | |
|---|---|---|---|
| 2,283,577 | 5/1942 | Roby | 49/326 X |
| 2,592,891 | 4/1952 | Hall | 49/340 |
| 3,341,813 | 9/1967 | Fletcher et al. | 49/25 X |
| 3,619,946 | 11/1971 | Crocker | 49/264 |
| 3,645,042 | 2/1972 | Bolli | 49/326 |
| 3,936,977 | 2/1976 | Runft | 49/340 X |
| 4,231,190 | 11/1980 | Tieben | 49/25 |
| 4,330,958 | 5/1982 | Richmond | 49/280 |

FOREIGN PATENT DOCUMENTS

| | | | |
|---|---|---|---|
| 2418856 | 3/1978 | France | 49/340 |
| 7600864 | 1/1976 | Netherlands | 49/340 |

*Primary Examiner*—Kenneth Downey

*Attorney, Agent, or Firm*—Gunn, Lee & Jackson

[57] ABSTRACT

The present invention is for an automatic gate opening device where commercial electricity is not economically available. A hydraulic cylinder operated by a bidirectional gear pump moves a cylinder rod which connects to an opening rod. The opening rod is pivotally connected to one end to the gate and on the other end to a stationary location. Due to pivotal connections and a pivotal linkage near the middle of the opening rod, the gate may be opened and closed by the hydraulic cylinder. The hydraulic cylinder is also pivotally mounted. Electronic controls may be operated by a number of different type sensors, including limit switches on the hydraulic cylinder, sensors for detecting the gate location, manual switches or other traditional vehicle approach sensors. Power is provided by a storage battery, which battery can be recharged during daylight hours at a solar panel or by a traditional battery charger.

10 Claims, 5 Drawing Figures

AUTOMATIC GATE OPENER

BACKGROUND OF THE INVENTION

The present invention relates to an automatic gate opener and, more particularly, to an automatic gate opening device that may be used at locations where commercial electricity is not economically available. By proper linkage and utilization of a hydraulic cylinder with a bidirectional gear pump, a gate may be opened and closed with appropriate electronic controls. The electronic controls may provide different types of sensors as well as a manual override for the opening and closing of the gate. Storage batteries can be used for providing the energy to operate the gate opening device and solar panels can be used for the recharging of the battery. By the appropriate electronic controls, this may be done automatically.

DESCRIPTION OF THE PRIOR ART

In ranch country, there may be a large number of acres fenced in with gates for roads going through the fenced acreage. Many times, commercial electricity is not available for the operation of the gates. If the roads are traveled fairly often, it is a tremendous inconvenience for individuals to have to stop to open and close the gates.

If a system for opening a gate is designed for operation off of a battery, it is very important that the system be highly efficient, or the battery will rapidly discharge and have to be recharged by commercial means.

Just as radio signals have been used to operate garage door openers, similar type radio signals have been used to operate gates. However, commercially available power is normally available and it is not critical for the system to be highly efficient.

Various types of gate or door opening devices have been designed in the past to utilize hydraulic cylinders and mechanical linkage. A typical such device is shown in U.S. Pat. No. 3,936,977 issued to Runft, et al., which has a double acting power cylinder. Pivotal interconnecting linkage is utilized to open a door depending upon the fluid operating the control piston inside of the cylinder.

Other types of gate opening devices have utilized a ram such as that shown in Vollmar (U.S. Pat. No. 3,500,585). The ram must be pivotally mounted and pivotally connected to the gate, plus have a motor to operate the ram. Such a system is not very efficient or practical for remote locations without commercially available power. In Vollmar, the entire motor pivots with the ram.

Further examples of typical prior art can be found in U.S. Pat. No. 3,645,042 issued to Bolli; U.S. Pat. No. 2,592,891 issued to Hall; and U.S. Pat. No. 4,231,190 issued to Tieben.

SUMMARY OF THE INVENTION

It is an object of the present invention to provide an automatic gate opening device.

It is another object of the present invention to provide an automatic gate opener that may be used at locations where commerical electricity is not economically available.

It is still another object of the present invention to provide a gate opener operated by a hydraulic cylinder controlled by a bidirectional gear pump with a cylinder rod operating pivotal linkage to open and close a gate, such pivotal linkage possibly including as many as six pivot points.

It is yet another object of the present invention to provide electronic controls for an automatic gate opener, which electronic controls provide a number of different options as far as available power that can be used, as well as different means for actuation and sensors to determine gate position.

It is another object of the present invention to provide a solar powered gate opener that may be used at remote locations, which gate opener is highly efficient.

The mechanical portion of the gate opener has a stationary base on which is pivotally mounted a hydraulic cylinder that may be operated in either direction by a bidirectional gear pump. The cylinder rod from the hydraulic cylinder connects to an opening rod with a center pivot linkage. The opening rod has one end pivotally connected to a stationary based. The oppose end of the opening rod is pivotally connected to the gate. The bidirectional gear pump may provide fluid to either end of the hydraulic cylinder, which hydraulic cylinder operates a piston contained therein for movement of the cylinder rod. Movement of the cylinder rod opens and closes the gate.

The control portion of the automatic gate opener operates the motor of the bidirectional gear pump. Sensors may be located on either end of the hydraulic cylinder to limit the amount of fluid supplied to the hydraulic cylinder, and hence control the position of the gate. Other sensors may be located in other positions to also determine the position of the gate. The gate may be opened or closed manually, by radio frequency signals or by automatic sensing devices. The particular type sensor to be used is left to the preference of the owner. A storage battery is used to provide energy for the automatic gate opener, which storage battery may be recharged either by a battery charger or by a solar device. Also, alternatively, energy may be received from commercially available electricity; however, the system is designed for use at locations that do not have commercially available electricity.

By the use of solid state switching, essentially no energy is being used when the gate is not being opened or closed. When the gate is being opened and closed, it is with the minimum amount of energy drain.

DESCRIPTION OF THE PREFERRED EMBODIMENT

Figure 1:
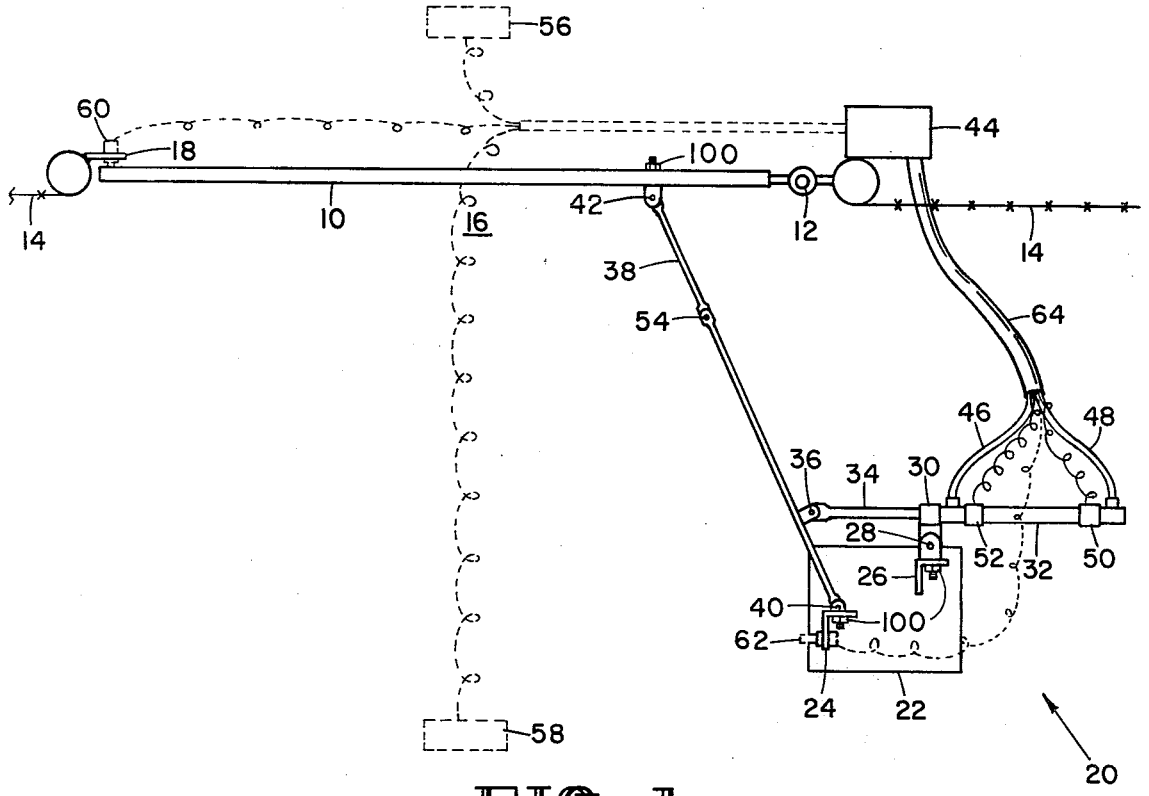
FIG. 1 is a pictorial overhead view of the mechanical portion of an automatic gate opener with the gate closed.
Figure 2:
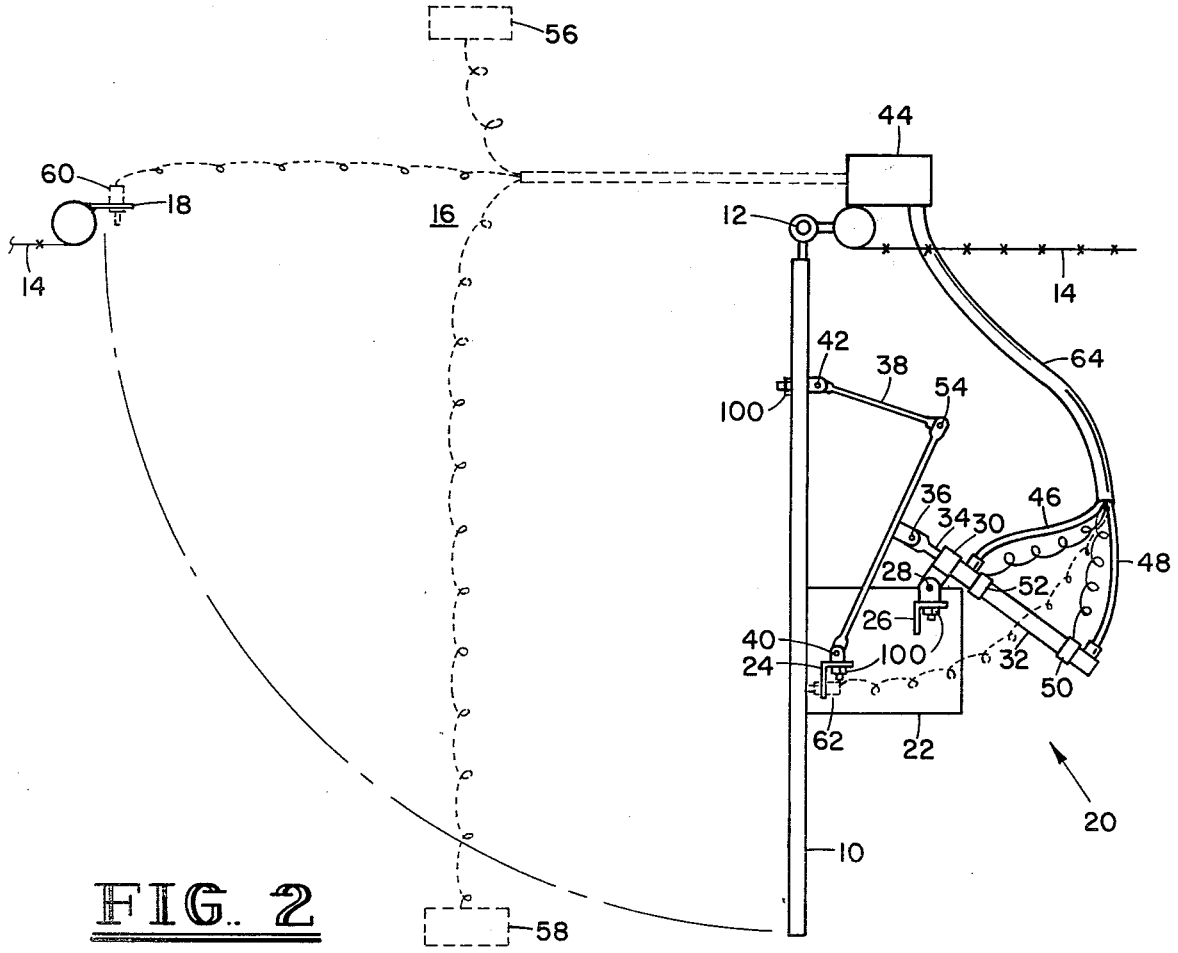
FIG. 2 is a pictorial overhead view of the mechanical portion of an automatic gate opener with the gate open.

Referring now to FIGS. 1 and 2 of the drawings in combination, there are shown overhead illustrative views of a gate 10 pivotally mounted on pivot point 12 to fence 14. Fence 14 has an opening 16 that is closed by the gate 10 to prevent livestock or other animals from getting across the fence 14. The opposite end of the gate 10 from the pivot point 12 rests against stop 18 when closed.

Operating the gate 10 is an automatic gate opener 20 which is pictorially illustrated in FIGS. 1 and 2. The automatic gate opener 20 has a base support 22 that may consist of any suitable structure, such as a poured concrete block. Mounted on the base support 22 is a mounting bracket 24 and a mounting bracket 26. Pivotally connected to mounting bracket 26 by means of pivot support 28 and clamp 30 is a hydraulic cylinder 32.

Inside of hydraulic cylinder 32 is a piston (not shown) to which is connected cylinder rod 34. As the piston in hydraulic cylinder 32 moves back and forth, the cylinder rod 34 attached thereto also extends and retracts. One end of the cylinder rod 34 is pivotally connected by pivot pin 36 to opening rod 38. A first end of opening rod 38 is connected through pivot pin 40 to mounting bracket 24 on base support 22. It should be realized that the base support 22 with the mounting brackets 24 and 26 is not movable.

The opposite end of the opening rod 38 is connected by pivot pin 42 to gate 10.

A control box 44 contains the appropriate electronic controls and a hydraulic fluid device (as will be explained in more detail subsequently) to open and close the gate 10. Hydraulic lines 46 and 48 receive hydraulic fluid from the control box 44 upon receiving an appropriate contol signal. Assume that control box 44 received a signal to open gate 10, hydraulic fluid will be supplied through hydraulic line 46 to retract the cylinder rod 34 inside of the hydraulic cylinder 32 as pictorially illustrated in FIG. 2. Upon the piston inside of the hydraulic cylinder 32 reaching a predetermined location, sensor 50 will sense the position of the piston and send a signal back to control box 44 to stop the flow of hydraulic fluid through hydraulic line 46 to stop the movement of the gate 10. The sensor 50 will only be activated when the gate 10 is opened as shown in FIG. 2.

Thereafter, if the control box 44 receives a signal to close the gate 10, hydraulic fluid is received through hydraulic line 48 from the control box 44 thereby projecting the cylinder rod 34 from the hydraulic cylinder 32 to close the gate 10 as shown in FIG. 1. At the time that gate 10 is closed, a sensor 52, which again detects the position of the piston inside of the hydraulic cylinder 32, sends a signal to the control box 44 to stop the flow of hydraulic fluid through hydraulic line 48. This should occur simultaneously with the gate 10 being closed as shown in FIG. 1.

By using the type of pivotal linkage as illustrated in FIGS. 1 and 2, the minimum amount of energy necessary for opening and closing the gate 10 is expended. A center pivot point 54 of the opening rod 38 allows the force being used to open gate 10 to be applied as close to perpendicular to the gate 10 as possible. This prevents the hydraulic cylinder 32 from exerting any more force than is absolutely necessary against pivot point 12 and opening the gate 10. When the gate 10 is closed, opening rod 38 with pivot point 54 acts as a knee brace to hold the gate 10 closed.

Other than a manual switch for control box 44, other types of sensors may be utilized, such as magnetic vehicle sensors 56 and 58. On either side of the approach path for the gate 10, magnetic vehicle sensors 56 and 58 may send a signal to the control box 44 upon a vehicle moving thereacross. The magnetic vehicle sensors 56 and 58 send a signal to the control box 44 in response to a change in the magnetic flux created by a vehicle moving thereacross. Such a magnetic vehicle sensor 56 or 58 can provide an automatic control signal for control box 44 to open or close the gate 10. This is an optional feature and other types of controls may be used as will be explained in more detail subsequently.

A switch 60 may be mounted on stop 18 to send a signal to the control box 44 when the gate 10 is closed. Likewise, a switch 62 may be mounted on mounting bracket 26 to indicate when the gate 10 is open. The switches 60 and 62 stop the flow of hydraulic fluid from the control box 44 through hydraulic lines 48 and 46, respectively, when the gate 10 is closed or opened, respectively. It should be realized that switches 60 and 62 are redundant with sensors 52 and 50, respectively, and provide an alternate control. The internal workings of the control box 44 will be shown in more detail subsequently.

Figure 3:
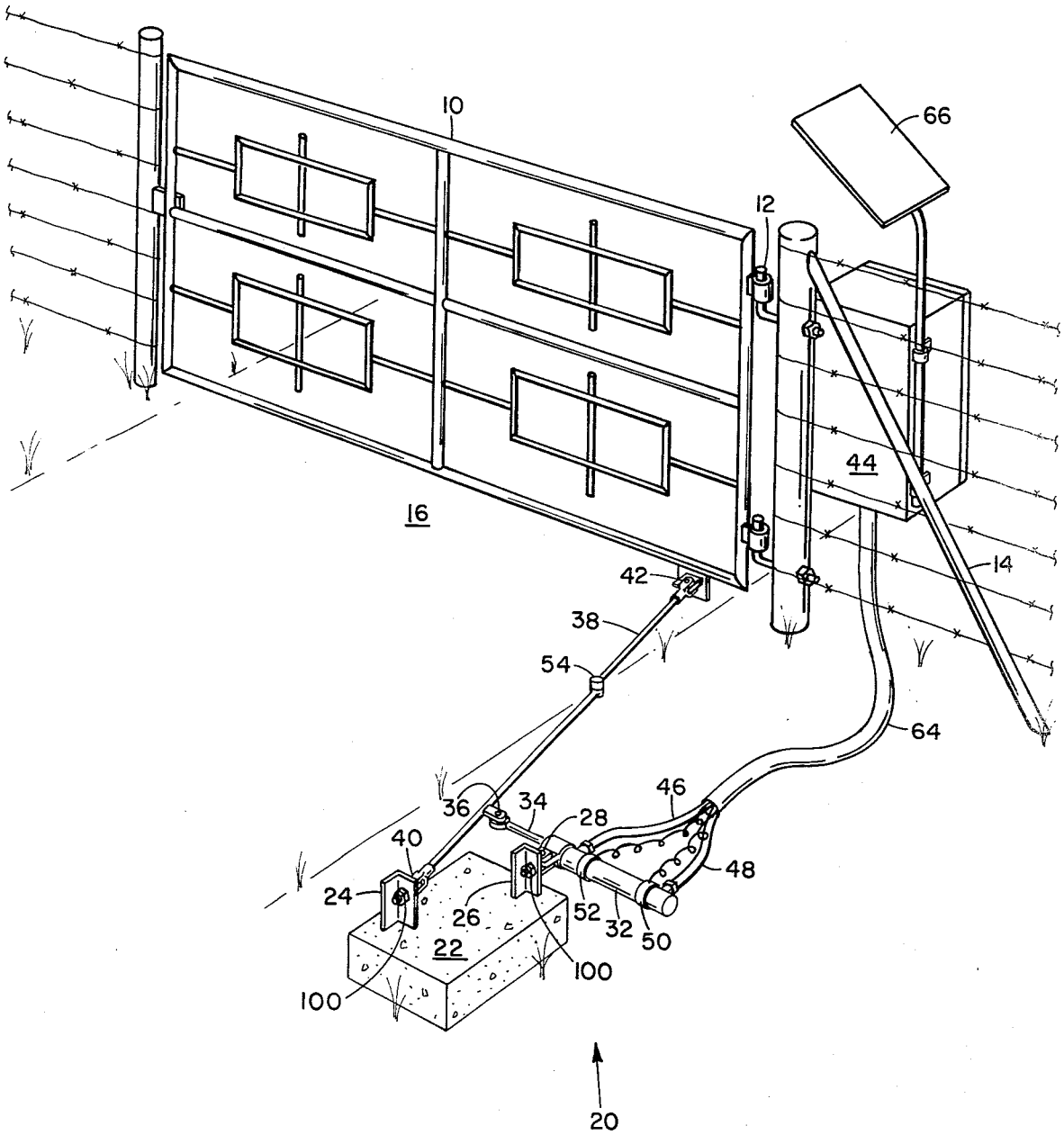
FIG. 3 is a perspective view of the automatic gate opener as installed.

Referring to FIG. 3, there is shown a perspective view of the gate 10 closed with the automatic gate opener 20 being shown in more detail. In the configuration as shown in FIG. 3, the auxiliary controls of magnetic vehicle sensors 56 and 58 and switches 60 and 62 have not been included. A control cable 64, which contains the hydraulic lines 46 and 48, therein also send signals from sensors 50 and 52 to the control box 44. Also as illustrated in FIG. 3 and as will be explained in more detail subsequently, a solar panel 66 may be used to recharge a storage cell or battery as may be contained in control box 44 during daylight hours.

Figure 5:
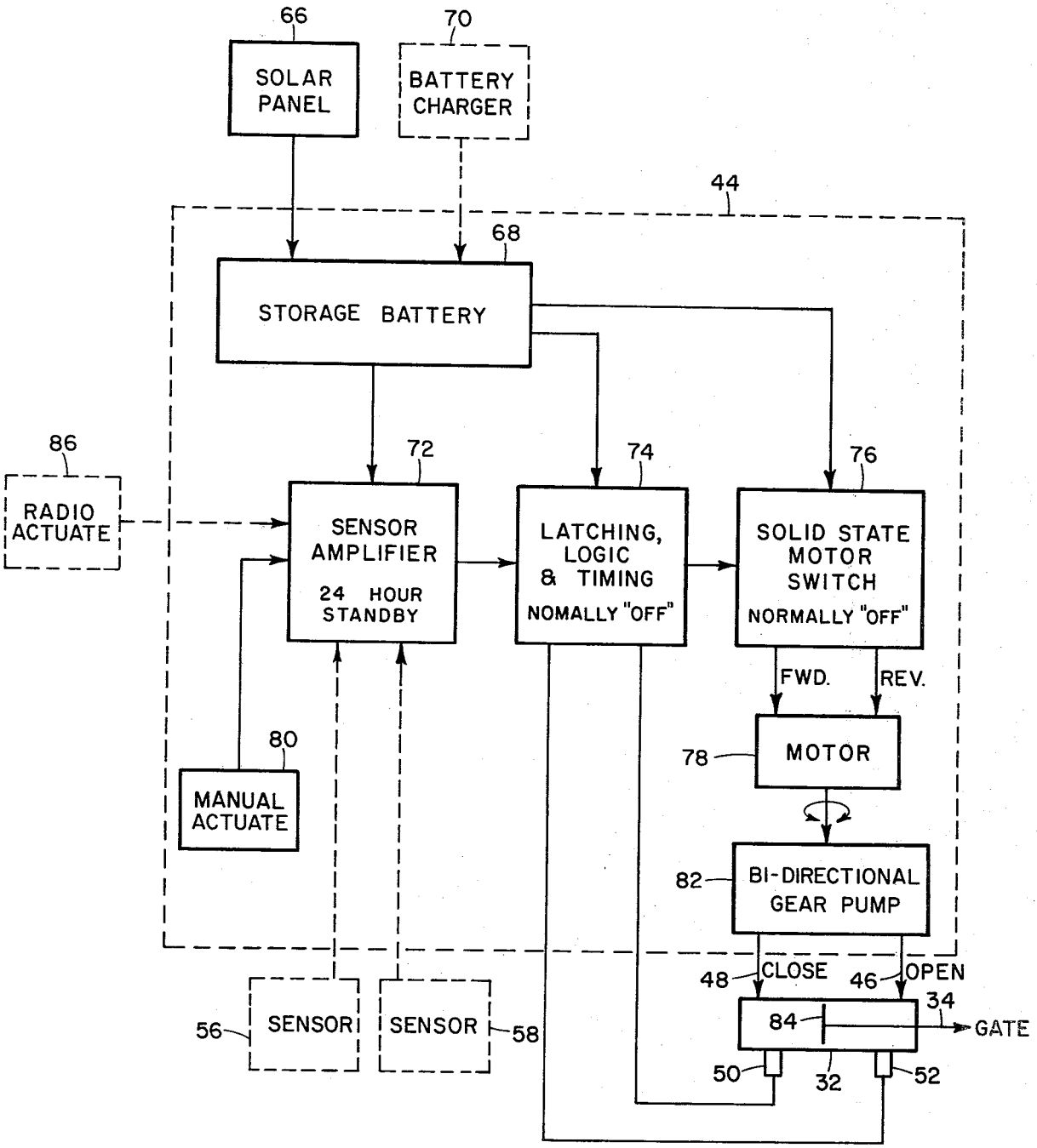
FIG. 5 is a block diagram of electrical components of the automatic gate opener.

Referring now to FIG. 5, the electronic controls and hydraulic system as contained in control box 44 will be explained in more detail. The solar panel 66 is used to recharge the storage batteries 68 as contained inside of the control box 44. While many different types of storage batteries can be used, applicant has found that a 12 volt battery with 5 amp hours with 80 amp peak current capability to be particularly suited for the present application. Also, the storage battery 68 may be recharged by an convenient means, such as a battery charger 70, if solar power is not appropriate. Also, rather than using storage battery 68, standard 120 volt AC power can be used with an appropriate converter to change the voltage to a constant DC voltage.

The storage battery 68 supplies power for a sensor amplifier 72; latching, logic and timing circuit 74; and a motor 78 via a solid state motor switch 76.

Assume that a manual actuate button 80 is pushed sending a signal to sensor amplifier 72 to either open or close the gate 10. Sensor amplifier 72 will amplify the signal to the latching, logic and timing circuit 74 to indicate the gate 10 should be either opened or closed. The latching, logic and timing circuit 74 will operate solid state motor switch 76 thereby causing the motor 78 to turn in either the forward or reverse direction. Depending upon the direction the motor 78 is turning, a bidirectional gear pump 82 is likewise turned. Depending upon the direction the bidirectional gear pump 82 is turned, hydraulic fluid will flow under pressure through either hydraulic line 46 to open the gate 10, or under pressure through hydraulic line 48 to close gate 10. The pressurized fluid being received inside of hydraulic cylinder 32 will move the piston 84 either to the right or left. Movement of the piston 84 to the left will cause the cylinder rod 34 to be retracted therein to open the gate 10. Movement of the piston 84 to the right will cause the cylinder rod 34 to be extended from the hydraulic cylinder 32 thereby closing the gate 10. As previously explained, sensors 50 and 52 will detect the piston 84 when it moves contiguous therewith. Displaced hydraulic fluid flows back through either hydraulic line 46 or 48 to bidirectional gear pump 82.

The sensing by sensors 50 or 52 of the piston 84 will cause a signal to be sent to latching, logic and timing 74 to switch the solid state motor switch 76 thereby cutting OFF power to the motor 78. This stops the flow of hydraulic fluid through the bidirectional gear pump 82 to the hydraulic cylinder 32, which in turn stops the movement of the gate 10.

In addition to the manual actuate button 80 as previously described, an optional feature includes a radio actuate 86, which is simply a radio transmitter similar to those used for garage door openers. The sensor amplifier 72 may have to be modified to have a receiving device therein prior to sending a signal to the latching, logic and timing circuit 74. Thereafter upon receiving a signal from the radio actuate 86, a signal is generated and sent to the latching, logic and timing circuit 74.

As another optional feature, magnetic vehicle sensors 56 and 58 as previously described can be utilized to determine if a vehicle is approaching the entrance to the gate. In the same way as an automatic magnetic triggering device would trigger a traffic light, sensors 56 and 58 can open and close the gate 10 upon a vehicle approaching the gate 10. However, for security purposes, an individual may elect not to include the magnetic vehicle sensors 56 and 58 depending upon their particular circumstance.

It should be realized that various options could be utilized, including switches 60 and 62 as previously described in conjunction with FIGS. 1 and 2, which options have not been described. Many different types of sensors for opening and closing the gate 10 are entirely feasible. Also many different alternative sources of power may be used; however, applicant particularly envisions this automatic gate opening device to be used at remote locations where commerical power is not readily available.

While different types of devices are available for providing pressurized hydraulic fluid, applicants have found a bidirectional gear pump 82 to be particularly efficient and require less energy than many other types of hydraulic devices.

Figure 4:
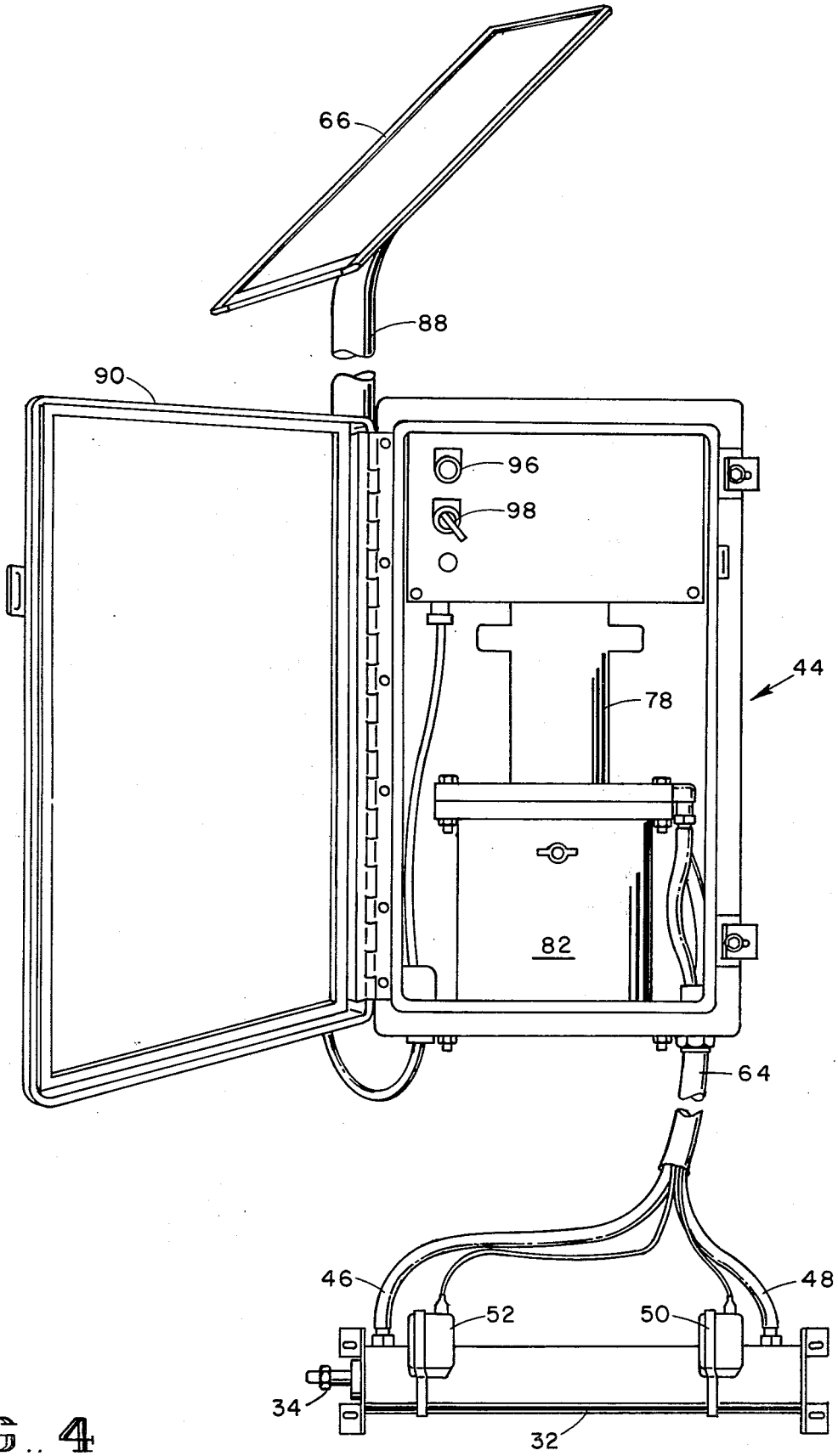
FIG. 4 is an elevational view of the active components of the automatic gate opener prior to installation with the housing of a control box being open.

Referring now to FIG. 4, the component parts requiring energy or generating energy are shown. The solar panel 66 is connected through conduit 88 to the control box 44. The door 90 of the control box 44 is opened to show the internal component parts. Inside of the control box 44 is located the motor 78, which drives the bidirectional gear pump 82, located within a hydraulic fluid reservoir. A manual actuate 80 is provided by switch 96 to either open or close the gate 10. A manual ON-OFF power switch 98 is also provided.

Upon installation of the automatic gate opening device as previously described hereinabove, there is a total of six pivot points including pivot point 12, pivot pin 42, center pivot point 54, pivot pin 36, pivot support 28, and pivot pin 40. Each of these pivot points should pivot about a vertical axis with respect to a horizontal plane. However, because a gate may not be mounted entirely perpendicular, and because the pivot points of the automatic gate opener 20 may not all operate in the same horizontal plane, pivot pin 42, pivot support 28, and pivot pin 40 should be able to rotate at least to a limited degree about a horizontal axis. Therefore, the mounting supports for these pivot points should be of such a nature to allow such pivotal rotation about the horizontal axis. Applicants have particularly found that the use of a self-locking bolt 100, which provides a loose connection with the mounting structure, to be particularly suitable for allowing the limited rotational movement about a horizontal axis. This prevents possible binding upon opening and closing of the gate 10. Many different types of connectors to allow pivotal motion along two axes may also be used. (See FIGS. 1 and 2.)

Referring back to the block diagram as shown in FIG. 5, the sensor amplifier 72 is on a 24 hour standby so that if a sensor is actuated, the signal is immediately amplified and provided to the latching, logic and timing circuit 74. This allows the minimum amount of power drain to keep the sensors in a standby condition. The latching, logic and timing circuit 74 is normally OFF as well as the solid state motor switch 76. The latching, logic and timing circuit 74 and the solid state motor switch 76 are only energized when the gate 10 is being opened or closed. This type of standby sensor draws approximately 1 milliamp in the 24 hour standby mode whereas commercially available gate openers that are connected to commerically available power normally draw approximately 50 milliamps continuous power as a minimum.

It is also envisioned that the storage battery 68 would be of the lead-acid type, which can supply approximately 80 amps peak current for immediate response. By use of a bidirectional gear pump 82 and motor 78, solenoid switching is not necessary thereby keeping the power drain low.

We claim:

1. A gate opening device for use at remote locations comprising:

stationary mounting means;

linkage rod pivotally connected on a first end to said stationary mounting means and pivotally connected on a second end to said gate, said linkage rod having an intermediate pivot point between said first and second ends thereof;

cylinder means pivotally mounted on said stationary mounting means, said cylinder means having a cylinder rod extending therefrom with a first end being pivotally connected to said linkage rod and a second end forming a piston inside said cylinder means;

control means connecting to said cylinder means for operating said cylinder means, said control means including a bi-directional gear pump for supplying hydraulic fluid to operate said cylinder means; and sensor means for signaling said control means to activate said bi-directional gear pump to suppy said hydraulic fluid under pressure to said cylinder means, said pressurized hydraulic fluid moving said gate to an opened or closed position via said piston, cylinder rod and linkage rod.

2. The gate opening device as given in claim 1 wherein said pivotal connections of said first and second ends of said linkage rod and pivotal mounting of said cylinder means allows at least limited pivotal movement about a horizontal axis.

3. The gate opening device as given in claim 1 wherein said control means includes an energy storage device for energizing said sensor means and bi-directional gear pump.

4. The gate opening device as given in claim 3 wherein said sensor means includes at least two piston sensors on said cylinder means to indicate a first and second position of said piston, said first position of said piston corresponding to when said gate is closed and said second position corresponding to said gate being opened.

5. The gate opening device as given in claim 3 wherein said sensor means includes magnetic detection devices adapted to be located in a road on either side of said gate, said magnetic detection devices sending a signal to said control means for opening said gate upon a vehicle approaching and closing said gate upon said vehicle passing therethrough.

6. The gate opening device as given in claim 3 wherein said control means includes a receiver for generating a control signal to open or close said gate upon receiving a predetermined transmitted signal.

7. The gate opening device as given in claim 3, 4, 5 or 6 wherein said control means includes:

sensor amplifier for amplifying signals received from said signal means;

logic means for receiving said amplified signal, said logic means operating a motor switch; and a motor receiving power from said energy storage device via said motor switch to turn said bi-directional gear pump to initiate opening or closing of said gate.

8. The gate opening device as given in claim 3 including means for recharging said energy storage device, said recharging means including at least one connection to a solar panel to recharge said energy storage device by solor energy.

9. The gate opening device as given in claim 8 comprising a manual override switch connected to said energy storage device and said control means to override sensor means to open or close said gate.

10. The gate opening device as given in claim 1 wherein said pivotal connections of said first and second ends of said linkage rod and pivotal mounting of said cylinder provide on-center linkage to mechanically lock said gate when in said closed position.

* * * * *